US006648187B1

(12) United States Patent
Shypkowski

(10) Patent No.: US 6,648,187 B1
(45) Date of Patent: Nov. 18, 2003

(54) EXTENDABLE SPOUT FOR USE WITH ICE AND WATER DISPENSERS

(76) Inventor: Eugene G. Shypkowski, 27502 Warrior Dr., Rancho Pales Verdes, CA (US) 90275

( * ) Notice: Subject to any disclaimer, the term of this patent is extended or adjusted under 35 U.S.C. 154(b) by 0 days.

(21) Appl. No.: 10/242,831

(22) Filed: Sep. 13, 2002

(51) Int. Cl.[7] ..... B67D 3/00
(52) U.S. Cl. ..... 222/527
(58) Field of Search ..... 222/527

(56) References Cited

U.S. PATENT DOCUMENTS 4,921,147 A * 5/1990 Poirier ..... 222/527

* cited by examiner

*Primary Examiner*—Philippe Derakshani

(57) ABSTRACT

An extendable ice and water spout comprising a cylindrical inlet adapter tube that is about 3-inches long coupling to one or more additional telescoping extendable tubes, each successive tube having a slightly smaller diameter so as to slide inside the adjacent connecting tube, and each tube having an outward extending lip at the top opening and an inward extending lip at the bottom opening to overlap and lock the tubes movably together when fully extended. O-ring sealing means are used between at the interface between sliding tubes to prevent the spilling of ice or water. The extendable spout measures at least 2-feet in length when fully extended to allow large containers such as coolers, water cans, and jugs, all to large to fit into the dispenser, to be filled with ice and water. Additionally, the flexible spout can be bent outward and downward by adjusting the tube sections to allow the inlet adapter tube to fit inside the dispenser cavity and the outlet end of the extendable spout to extend outside the cavity and down into the container. Also, the spout can be collapsed to less than 6-inches for storing.

20 Claims, 2 Drawing Sheets

EXTENDABLE SPOUT FOR USE WITH ICE AND WATER DISPENSERS

BACKGROUND OF THE INVENTION

1. Field of the Invention

The present invention relates to extendable spouts for use in connection with ice and water dispensers on refrigerators. The extendable spout has particular utility in connection with filling large coolers, jugs, and other vessels without spillage.

2. Description of the Prior Art

Ice and water dispensers on the door of modem refrigerators have become a most desirable feature. However, filling a vessel larger than a drinking glass without spillage is quite difficult. Extendable spouts for such dispensers for use in filling larger vessels are known in the prior art. For example, U.S. Pat. No. 5,148,842 to Boust discloses a funnel-adapter for use in dispensing water and ice from a refrigerator water and ice dispenser, which has a curved cylindrical hand-held funnel that can be used to fill larger pitchers and bottles. However, the Boust '842 patent discloses a device that is fixed in length and therefore cannot be extended in length to reach a cooler or other container sitting on the floor, and has the further drawback of being rigid and non-adjustable in tilt angle.

U.S. Pat. No. 1,946,760 to Rhine discloses an extendable spout that has a pivotal chute, primarily for use with grain elevators. However, the Rhine '760 patent does not have slideable sections for extending the length and cannot be collapsed to a short length for storage.

Similarly, U.S. Des. Pat. No. D288,520 to Bozarth discloses the design for a waterspout for a water cool. However, the Bozarth '520 patent has fixed angles and cannot be extended in length.

Lastly, U.S. Pat. No. 4,347,878 to Schofield, U.S. Pat. No. 3,927,703 to Beaubien, and U.S. Pat. No. 3,939,884 to Mader all disclose funnels with various types of spouts, which may be of general interest and pertinent to the construction and design of the present invention. However, all of these patents describe different structures from that of the present invention and none has extendable spouts or chutes that can be collapsed to short length for storing.

While the above-described devices fulfill their respective, particular objectives and requirements, the aforementioned patents do not describe a collapsible ice and water extendable spout that can be extending to long lengths for filling coolers, water cans, and other large vessels.

Therefore, a need exists for a new and improved ice and waterspout that can be extended to fill large containers that won't fit in an ice and water dispenser cavity and can also be collapsed to a short length for storing. In this regard, the present invention substantially fulfills this need. In this respect, the collapsible ice and water extendable spout according to the present invention substantially departs from the conventional concepts and designs of the prior art, and in doing so provides an apparatus primarily developed for the purpose of servicing large vessels with ice and water.

SUMMARY OF THE INVENTION

In view of the foregoing disadvantages inherent in the known types of extendable spouts and chutes now present in the prior art, the present invention provides an improved ice and water extendable spout, and overcomes the above-mentioned disadvantages and drawbacks of the prior art. As such, the general purpose of the present invention, which will be described subsequently in greater detail, is to provide a new and improved collapsible ice and water extendable spout, which has all the advantages of the prior art mentioned heretofore and many novel features that result in an extendable spout that is not anticipated, rendered obvious, suggested, or even implied by the prior art, either alone or in any combination thereof.

The extendable spout of the present invention is an accessory for use with refrigerators equipped with ice and water dispensers. In general, the device is comprised of a specially configured plastic tubing product. More specifically, one end has a rigid inlet section, which is approximately 3-inches in diameter and 3-inches long. Additional telescoping sections allow the spout to be extended to at least 3-feet in length with an outlet tube diameter of at least 2½ inches.

To attain this, the present invention essentially discloses an extendable telescoping tube, which can be positioned over one of the spouts in an ice or water dispenser for funneling the ice or water into a container that is too large to fit into the dispenser's cavity. The extendable tube comprises a cylindrical inlet adapter tube that is about 3-inches long with a rubber insert around the inside diameter for sealing off the interface between the tube and the dispenser chute. Both the top and bottom of the inlet adapter tube are open, with the bottom having a means for coupling to additional extendable tube sections. The cylindrical shape of the inlet adapter tube fits against the curved portion of the dispenser's push-lever to enable the supply of ice or water. A first extendable tube, whose outside diameter is sized to slide inside the inlet adapter tube, has an outward extending lip that connects to the bottom portion of the inlet adapter tube by attachment means, thereby locking the tubes movably together. One or more additional extendable telescoping tubes are used to extend the length of the spout, with each successive tube having a slightly smaller diameter so as to slide inside the adjacent tube, and each tube having an outward extending lip at the top opening and an inward extending lip at the bottom opening to lock the tubes movably together when fully extended. O-ring sealing means are used at the interface between sliding tubes to prevent the spilling of ice or water.

The extendable spout measures at least 2 feet in length when fully extended to allow large containers like coolers, water cans, and jugs, all to large to fit into a dispenser cavity, to be filled with ice and water (or other beverage, such as ice tea, soft drink, lemonade, etc.) Additionally, the spout can be bent outward and downward by adjusting the tube sections to allow the inlet adapter tube to fit inside the dispenser cavity and the outlet end of the extendable spout to extend outside the cavity, down into the container. The assembly can be collapsed to less than 6-inches for storing.

In use, the inlet tube is placed over the underside of the door-mounted ice or water discharge chute of a refrigerator, while the lower end of the extendable spout is inserted into a cooler, pitcher, or other vessel. The inlet tube is then pressed against the release lever of the appliance, thereby allowing ice or water to flow into the container.

The extendable spout can be used with refrigerators fitted with an outside door dispenser cavity or with beverage machines used in fast-food restaurants, which dispense ice and beverage.

There has thus been outlined, rather broadly, the more important features of the invention in order that the detailed description thereof that follows may be better understood and in order that the present contribution to the art may be better appreciated.

There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention is to provide a new ice and water extendable spout that provides in the apparatuses and methods of the prior art some of the advantages thereof, while simultaneously overcoming some of the disadvantages normally associated therewith.

It is another object of the present invention is to provide an extendable spout that can be extended in length and profile to allow the filling of large containers with ice and water directly from a conventional ice and water dispenser without spillage and can be collapsed to a small size for storage.

A further object of the present invention is to provide a new and improved ice and water extendable spout that may be easily and efficiently manufactured and marketed.

Lastly, an even further object of the present invention is to provide a new and improved ice and water extendable spout that has a low cost of manufacture with regard to both materials and labor, and which accordingly is then susceptible of low prices of sale to the consuming public, thereby making such extendable spouts economically available to the buying public.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
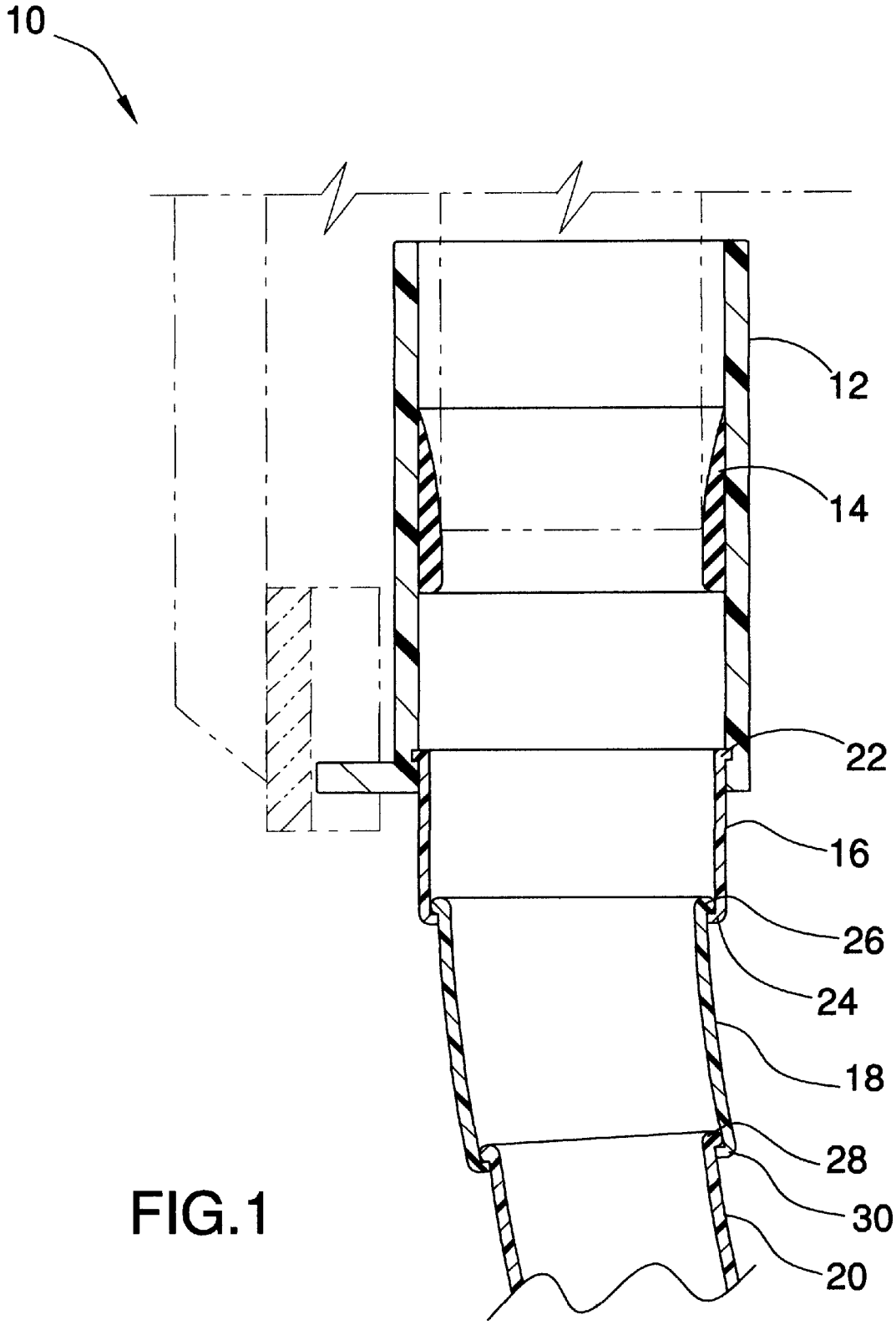
FIG. 1 is a drawing of the showing the various expandable sections of the extendable spout as constructed in accordance with the principles of the preferred embodiment of the present invention.
Figure 2:
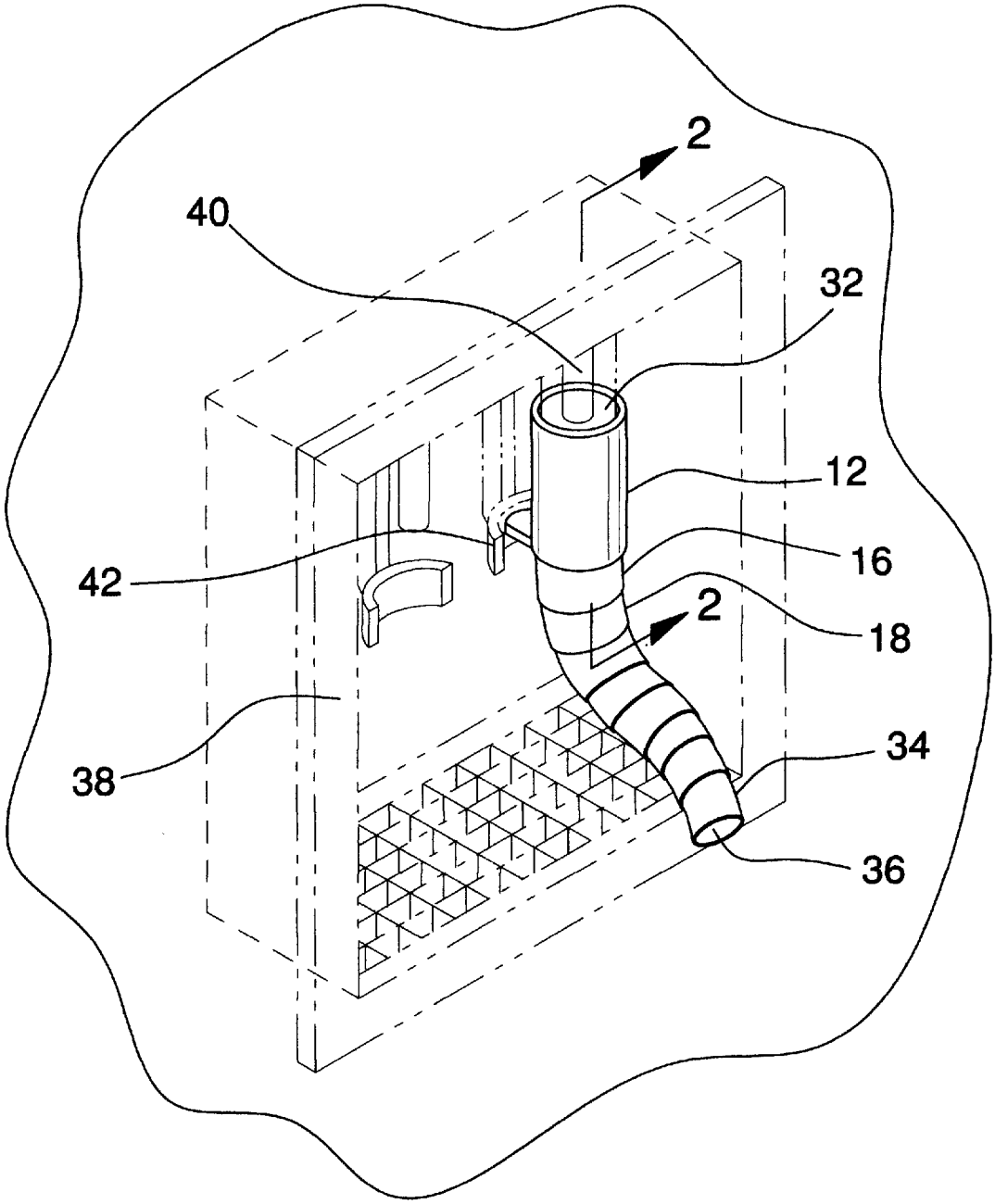
FIG. 2 is a perspective view of the extendable spout of the present invention for use in combination with an ice and water dispenser.

Referring now to the drawings, and particularly to FIGS. 1 and 2, a preferred embodiment of the extendable spout of the present invention is shown and generally designated by the reference numeral 10. The extendable spout of the present invention is an accessory for use with refrigerator equipped with ice and water dispensers. In general, the device is comprised of a specially configured plastic tubing product. One end has a rigid inlet section, which is approximately 3-inches in diameter and 3-inches long. Additional telescoping sections allow the spout to be extended to at least 3-feet in length with an outlet tube diameter of at least 2½ inches.

In FIG. 1, a new and improved extendable spout 10 of the present invention for use in filling large containers from a refrigerator ice and water dispenser is illustrated and will be described. More particularly, the extendable spout 10 has a cylindrical inlet adapter tube 12 that is about 3-inches long with a rubber insert 14 slightly extending from around the inside diameter of the adapter tube for sealing off the interface between the tube and the dispenser's ice chute. Both the top and bottom of the inlet adapter tube are open, with the bottom being capable of coupling to additional extendable tube sections. The cylindrical shape of the inlet adapter tube fits against the curved portion of the dispenser's push-lever to enable the supply of ice or water. A first extendable tube 16, whose outside diameter is sized to slide inside the inlet adapter tube 12, extends from the bottom of the inlet adapter tube and at the top has an outward extending lip 22 that connects to the bottom portion of the inlet adapter tube 12 by attachment means and at the bottom has an inward extending lip 24 for connecting to additional tube sections, thereby locking the tubes movably together. One or more additional extendable telescoping tubes 18–20, each successive tube having a slightly smaller diameter so as to slide inside the adjacent tubes are attached to the bottom of the first extendable tube 16. These additional tubes have outward extending lips 26–28 at the top openings and inward extending lips 30 at the bottom openings to lock the tubes movably together when fully extended. An, o-ring sealing means (not shown) is used at the interface between sliding tubes to prevent the spilling of ice or water.

The extendable spout measures at least 2 feet in length when fully extended to allow large containers like cooler, water cans, and jugs, all too large to fit into a dispenser, to be filled with ice and water. Additionally, the spout can be bent outward and downward by adjusting the tube sections to allow the inlet adapter tube to fit inside the dispenser cavity and the outlet end of the extendable spout to extend outside the cavity and down into a container. The assembly can be collapsed to less than 6-inches for storing.

FIG. 2 is a perspective view of the collapsible extendable spout of the present invention as used in combination with an ice and water dispenser 38. The cylindrical inlet adapter tube 12 has a top inlet opening 32, which is at least 3-inches in diameter with the extendable spout gradually getting smaller in diameter as the tube section are inserted into one another. The bottom tube section 34 has an outlet opening 36 that is at least 2½ inches in diameter. All materials used in manufacturing the extendable spout will be approved for use with drinking water for health purposes.

In use, the inlet tube 12 is placed around one of the door-mounted ice or water discharge chutes 40 of a refrigerator ice and water dispenser 38, while the lower end of the extendable spout 34 is inserted into a cooler or other container. The inlet tube 12 is then pressed against the push-lever 42 of the appliance, thereby allowing ice or water to flow into the container.

While a preferred embodiment of the ice and water extendable spout has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material such as plastic, nylon, or metal may be used to fabricate the telescoping spout. Also, the extendable spout can be used with any suitable ice and water dispenser. In addition, the spill-proof extendable spout with slidable seals can be used in other applications such as draining the oil from a vehicle.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. An extendable spout for use with an ice and water dispenser, comprising:

a cylindrical inlet adapter tube for coupling to an ice and water dispenser chute, said inlet adapter tube being open at both top and bottom ends, said bottom end having a means for coupling to additional spout sections;

a pressure seal extending slightly outward from the inside circumference of said inlet adapter tube for sealing the interface between said dispenser chute and said inlet adapter tube to prevent spilling of said ice and water;

a first extendable tube coupled to the bottom inside of said inlet adapter tube, said extendable tube having an outside diameter slightly smaller than the inside diameter of said inlet adapter tube, said extendable tube capable of engaging and sliding downward from the bottom of said inlet adapter tube, said inlet adapter tube being stopped by overlapping lip means between said inlet adapter tube and said extendable tube, said interface between said extendable tube and said inlet adapter tube being made leak-proof by sealing means; and one or more additional telescoping extendable tubes coupled one to another extending the length of said extendable spout, each successive telescoping extendable tube having an outside diameter smaller than the inside diameter of the adjacent preceding connecting tube, each said telescoping extendable tube capable of sliding downward from the bottom of said preceding connecting tube and being stopped by overlapping lipping means, said interface between said successive extendable tubes being made leak-proof by sealing means, thereby extending the length of said extendable spout to sufficiently deliver ice and water to a container too large to fit into said ice and water dispenser.

2. The extendable spout of claim 1, wherein said extendable spout can be extended to a length of at least two feet, thereby allowing coolers and water cans to be filled while sitting on the floor.

3. The extendable spout of claim 1, wherein said extendable spout can be collapsed to a length of less than 6 inches, thereby allowing said spout to be easily stored.

4. The extendable spout of claim 1, wherein the inside diameter of the bottom telescoping extendable tube is at least 2½-inches, thereby allowing typical size ice cubes to flow through the outlet opening.

5. The extendable spout of claim 1, wherein said extendable spout can be flexibly adjusted so that the lower end of said telescoping spout is laterally offset from said inlet adapter tube, thereby allowing said extendable spout to deliver ice and water from a small dispenser chamber to a larger vessel outside said dispenser.

6. The extendable spout of claim 1, said overlapping lipping means further comprising an outward extending circular lip around the top outside diameter of each said extendable tube and an inward extending circular lip around the bottom inside diameter of each said extendable tube, said outward extending lip around said top outside diameter having an outside diameter slightly less than the inside diameter of said adjacent preceding connecting tube, and said inward extending circular lip around said bottom inside diameter of each said extendable tube having an inside diameter slightly greater than the outside diameter of the adjacent successive connecting tube, said outward and inward lips overlapping at the full extended position of said extendable tubes, thereby terminating the telescoping action of said tubes.

7. The extendable spout of claim 1, said sealing means further comprising an o-ring type seal.

8. An extendable spout in combination with a refrigerator ice and water dispenser, comprising:

a refrigerator having an ice and water dispenser mounted in an outside door cavity, said dispenser further having an ice chute and a water chute;

a cylindrical inlet adapter tube, said inlet adapter tube being open at both the top and bottom ends, said top end having a means for coupling to said ice or water dispenser chute mounted in said outside door cavity of said refrigerator, said bottom end of said adapter tube having a means for coupling to additional spout sections;

a pressure seal extending slightly outward from the inside circumference of said inlet adapter tube for sealing the interface between said dispenser chute and said inlet adapter tube to prevent spilling of said ice and water;

a first extendable tube coupled to the bottom inside of said inlet adapter tube, said extendable tube having an outside diameter slightly smaller than the inside diameter of said inlet adapter tube, said extendable tube capable of engaging and sliding downward from the bottom of said inlet adapter tube, said inlet adapter tube being stopped by overlapping lip means between said inlet adapter tube and said extendable tube, said interface between said extendable tube and said inlet adapter tube being made leak-proof by sealing means; and one or more additional telescoping extendable tubes coupled one to another extending the length of said extendable spout, each successive telescoping extendable tube having an outside diameter smaller than the inside diameter of the adjacent preceding connecting tube, each said telescoping extendable tube capable of sliding downward from the bottom of said preceding connecting tube and being stopped by overlapping lipping means, said interface between said successive extendable tubes being made leak-proof by sealing means, thereby extending the length of said extendable spout to sufficiently deliver ice and water to a container too large to fit into said ice and water dispenser.

9. The extendable spout of claim 8, wherein said extendable spout can be extended to a length of at least two feet, thereby allowing coolers and water cans to be filled from said door mounted ice and water dispenser, while sitting on the floor.

10. The extendable spout of claim 8, wherein said extendable spout can be collapsed to a length of less than 6 inches, thereby allowing said spout to be easily stored.

11. The extendable spout of claim 8, wherein the inside diameter of the bottom telescoping extendable tube is at least 2½-inches, thereby allowing typical size ice cubes to flow through the outlet opening.

12. The extendable spout of claim 8, wherein said extendable spout can be flexibly adjusted so that the lower end of said telescoping spout is laterally offset from said inlet adapter tube positioned in said refrigerator door cavity, thereby allowing said extendable spout to deliver ice and water from said dispenser to a larger vessel.

13. The extendable spout of claim 8, said overlapping lipping means further comprising an outward extending circular lip around the top outside diameter of each said extendable tube and an inward extending circular lip around the bottom inside diameter of each said extendable tube, said outward extending lip around said top outside diameter having an outside diameter slightly less than the inside diameter of said adjacent preceding connecting tube, and said inward extending circular lip around said bottom inside diameter of each said extendable tube having an inside diameter slightly greater than the outside diameter of the adjacent successive connecting tube, said outward and inward lips overlapping at the full extended position of said extendable tubes, thereby terminating the telescoping action of said tubes.

14. The extendable spout of claim 8, said sealing means further comprising an o-ring type seal.

15. An ice and beverage dispensing system for use in filling large vessel, comprising:

an ice and beverage dispensing machine, said machine having an ice dispensing spout and a plurality of dispenser beverage spouts aligned in a row, said machine having limited access beneath said spouts, said spouts being enabled by push-lever valves;

an extendable spout capable of coupling to anyone of said ice and beverage spouts, said extendable spout further comprising:

a cylindrical inlet adapter tube being positioned over anyone of said ice or beverage spouts, said inlet adapter tube being open at both top and bottom ends, said bottom end having a means for coupling to additional spout sections;

a pressure seal extending slightly outward from the inside circumference of said inlet adapter tube for sealing the interface between said dispenser spout and said inlet adapter tube to prevent spilling of said ice and beverage;

a first extendable tube coupled to the bottom inside of said inlet adapter tube, said extendable tube having an outside diameter slightly smaller than the inside diameter of said inlet adapter tube, said extendable tube capable of engaging and sliding downward from the bottom of said inlet adapter tube, said inlet adapter tube being stopped by overlapping lip means between said inlet adapter tube and said extendable tube, said interface between said extendable tube and said inlet adapter tube being made leak-proof by sealing means; and one or more additional telescoping extendable tubes coupled one to another extending the length of said extendable spout, each successive telescoping extendable tube having an outside diameter smaller than the inside diameter of the adjacent preceding connecting tube, each said telescoping extendable tube capable of sliding downward from the bottom of said preceding connecting tube and being stopped by overlapping lipping means, said interface between said successive extendable tubes being made leak-proof by sealing means, thereby extending the length of said extendable spout to fill a large container too large to fit in said ice and beverage machine's container area.

16. The system of claim 15, wherein said extendable spout can be extended to a length of at least two feet, thereby allowing coolers and beverage cans to be filled while sitting on the floor.

17. The system of claim 15, wherein said extendable spout can be collapsed to a length of less than 6 inches, thereby allowing said spout to be easily stored.

18. The system of claim 15, wherein said extendable tubes can be flexibly adjusted so that the lower end of said telescoping spout is laterally offset from said inlet adapter tube, thereby allowing said extendable spout to deliver ice and beverage from a small dispenser chamber to a larger vessel outside said dispenser.

19. The system of claim 15, said overlapping lipping means further comprising an outward extending circular lip around the outside diameter at the top end of each said extendable tube and an inward extending circular lip around the inside diameter at the bottom end of each said extendable tube, said outward extending lip having an outside diameter slightly less than the inside diameter of said adjacent preceding connecting tube, and said inward extending circular lip around the inside diameter at the bottom end of each said extendable tube having an inside diameter slightly greater than the outside diameter of the adjacent successive connecting tube, said outward and inward lips overlapping at the full extended position of said extendable tubes, thereby terminating the telescoping action of said tubes.

20. The system of claim 15, said sealing means further comprising an o-ring type seal.

* * * * *